US011203555B2

(12) United States Patent
Beattie et al.

(10) Patent No.: US 11,203,555 B2
(45) Date of Patent: Dec. 21, 2021

(54) BLASTING AGENT

(71) Applicant: The University of Sydney, New South Wales (AU)

(72) Inventors: James Kenneth Beattie, New South Wales (AU); Alex Masato Djerdjev, New South Wales (AU); Brian Stanley Hawkett, New South Wales (AU); Chiara Neto, New South Wales (AU); Pramith Priyananda, New South Wales (AU)

(73) Assignee: The University of Sydney Commercial Development & Industry Partnerships

( * ) Notice: Subject to any disclaimer, the term of this patent is extended or adjusted under 35 U.S.C. 154(b) by 318 days.

(21) Appl. No.: 15/756,636

(22) PCT Filed: Sep. 1, 2016

(86) PCT No.: PCT/AU2016/050825
§ 371 (c)(1),
(2) Date: Mar. 1, 2018

(87) PCT Pub. No.: WO2017/035594
PCT Pub. Date: Mar. 9, 2017

(65) Prior Publication Data

US 2018/0244590 A1 Aug. 30, 2018

(30) Foreign Application Priority Data

Sep. 1, 2015 (AU) ..... 2015903557

(51) Int. Cl.
*C06B 23/00* (2006.01)
*C06B 31/28* (2006.01)
(Continued)

(52) U.S. Cl.
CPC ..... *C06B 23/006* (2013.01); *C06B 31/285* (2013.01); *C06B 47/145* (2013.01); *F42D 1/10* (2013.01); *F42D 5/00* (2013.01)

(58) Field of Classification Search
None
See application file for complete search history.

(56) References Cited

U.S. PATENT DOCUMENTS 651,086 A 6/1900 Prothero
1,596,622 A 8/1926 Patrick
(Continued)

FOREIGN PATENT DOCUMENTS

CN 102432406 2/2013
EP 0460952 12/1991
(Continued)

OTHER PUBLICATIONS

International Search Report and Written Opinion dated Apr. 9, 2019 for PCT/AU2019/050003.
(Continued)

*Primary Examiner* — Aileen B Felton
(74) *Attorney, Agent, or Firm* — Stoel Rives LLP

(57) ABSTRACT

The present invention provides a method of stabilizing a nitrate-based explosive through the use of a NOx scavenger. The present invention further provides a blasting agent including ammonium nitrate and a NOx scavenger. The present invention further provides for a method of blasting adapted for use in reactive and/or elevated temperature ground.

7 Claims, 3 Drawing Sheets

(51) Int. Cl.

| | |
|---|---|
| ***C06B 47/14*** | (2006.01) |
| ***F42D 1/10*** | (2006.01) |
| ***F42D 5/00*** | (2006.01) |

(56) References Cited

U.S. PATENT DOCUMENTS

| | | | | |
|---|---|---|---|---|
| 3,374,128 | A | 3/1968 | Stronza et al. | |
| 3,886,008 | A | 5/1975 | Cook | |
| 4,061,511 | A | 12/1977 | Baczuk | |
| 4,273,147 | A | 6/1981 | Olney | |
| 4,737,207 | A | 4/1988 | Ehrnstrom et al. | |
| 5,159,153 | A | 10/1992 | Cranney et al. | |
| 5,366,571 | A | 11/1994 | Ruhe et al. | |
| 5,567,911 | A | 10/1996 | Ekman | |
| 5,907,119 | A | 5/1999 | Cranney | |
| 6,125,761 | A | 10/2000 | Smith, Jr. et al. | |
| 6,165,297 | A | 12/2000 | Smith et al. | |
| 6,386,296 | B1 | 5/2002 | Kothari et al. | |
| 8,404,203 | B2 | 3/2013 | Bull et al. | |
| 9,902,786 | B2 | 2/2018 | Koch et al. | |
| 10,065,899 | B1 | 9/2018 | Luna | |
| 2002/0023699 | A1 | 2/2002 | Matsuoka et al. | |
| 2004/0055677 | A1 | 3/2004 | Filippini et al. | |
| 2007/0084532 | A1 | 4/2007 | Burns et al. | |
| 2007/0117710 | A1* | 5/2007 | Lawrence | B01D 53/02 502/60 |
| 2011/0056598 | A1* | 3/2011 | Twomey | C06B 31/30 149/11 |
| 2011/0120603 | A1 | 5/2011 | Cordova et al. | |
| 2014/0230679 | A1 | 8/2014 | Goodridge | |
| 2014/0311634 | A1* | 10/2014 | McPhail | C06B 23/00 149/46 |
| 2018/0009723 | A1 | 1/2018 | Paris et al. | |
| 2018/0244590 | A1 | 8/2018 | Beattie et al. | |
| 2019/0210939 | A1 | 7/2019 | Pettersen et al. | |
| 2019/0257632 | A1 | 8/2019 | Nelson et al. | |
| 2021/0025682 | A1 | 1/2021 | Nelson et al. | |

FOREIGN PATENT DOCUMENTS

| | | |
|---|---|---|
| EP | 0895055 | 2/1999 |
| EP | 1458660 | 9/2004 |
| GB | 435588 | 9/1935 |
| RU | 1811520 | 4/1993 |
| RU | 96103417 | 4/1998 |
| RU | 2173776 | 9/2001 |
| RU | 2215983 | 11/2003 |
| RU | 2305674 | 9/2007 |
| WO | 198902881 | 4/1989 |
| WO | 2013131139 | 9/2013 |
| WO | 2015073561 | 5/2015 |

OTHER PUBLICATIONS

Notice of Allowance dated Jul. 21, 2020 for U.S. Appl. No. 16/279,532.

Gunawan, et al., Thermal Stability and Kinetics of Decomposition ofAmmonium Nitrate in the Presence of Pyrite, Journal of Hazardous Materials, 165, 2009, 751-758.

Sapko, et al., Chemical and Physical Factors That Influence NOx Production During Blasting—Exploratory Study, 2002.

European Search Report dated Aug. 18, 2021 for EP19738574.3.

* cited by examiner

BLASTING AGENT

This document claims priority from AU 2015903557, the entire contents of which are hereby incorporated by reference in their entirety.

TECHNICAL FIELD

The present invention relates generally to the field of nitrate-based explosives. More particularly, the present invention relates to the field of stabilising nitrate-based explosives, preventing unintentional decomposition and increasing the safety and stability of nitrate-based explosives in elevated temperature and reactive ground mining.

BACKGROUND ART

Blasting agents comprising ammonium nitrate (AN) or other nitrate salts such as potassium nitrate or sodium nitrate are widely used in the mining industry. A 'blasting agent' is a type of explosive known as a "tertiary explosive". Blasting agents—or tertiary explosives (sometimes referred to as just explosives)—are sometimes selected for safety due to their inability to be triggered through shock or other forms of conventional explosive triggering. As such, blasting agents typically require a primer charge in order to initiate the reaction. This primer charge is far more energetic than is required by primary explosives (for example, silver fulminate, ethyl azide or mercury nitride), which are so shock-sensitive they may be reliably initiated through the impact of a hammer; even secondary explosives (such as TNT or RDX) can be triggered through the use of a blasting cap, which is typically a smaller charge than a primer.

Commercially used nitrate-based explosives are blasting agents, and thus are relatively insensitive to accidental explosive initiation. This extreme insensitivity to explosive initiation makes blasting agents ideal for use on mine sites. However, the safety and effectiveness of such blasting agents can be compromised if they are used in reactive ground, and even more so if the temperature of the ground is elevated (e.g. above about 55° C.). Reactive ground is ground which contains chemical species that can react with the nitrate component of the explosive, and includes ground that contains significant quantities of metal sulphides such as pyrite (although the presence of pyrite in a borehole is not necessarily required, as its reactive components—Fe(II) and acid—can generate elsewhere and leach into the borehole). When nitrate-based blasting agents are charged into boreholes in reactive ground, the nitrate component reacts with the metal sulphide and the acid to generate heat. If sufficient heat is generated, the blasting agent can prematurely detonate. A premature detonation can lead to blasting agents on the surface and in other holes detonating and possible injury or death to those working on the shot. Furthermore, the presence of reactive ground in boreholes where the temperature is elevated can result in the decomposition process occurring at a faster rate.

The terms reactive ground and elevated temperature/hot ground are described in the Australian Explosives Industry And Safety Group Inc (AEISG) Code of Practice Edition 3, June 2012, the contents of which are hereby incorporated by reference. 'Reactive ground' can mean material with an induction stage less than a desired time period, wherein the induction stage is the length of time it takes for the chemical system comprising the constituents of the reactive ground and the blasting agent to react so as to cause thermal decomposition of the nitrate. Generally speaking, material is considered reactive ground if the induction stage is less than one week, or less than four times the desired sleep time for the blasting agent.

As defined in the AEISG Code of Practice, 'hot ground' can mean ground with a temperature between 55° C. and 100° C., while 'high temperature ground' is ground with a temperature above 100° C. 'Elevated temperature ground' refers to both hot ground and high-temperature ground.

Elevated temperature and reactive ground have been identified as an issue dating as far back as 1963 when ANFO was loaded into reactive ground at Mt Isa, QLD, Australia resulting in a premature detonation. A similar incident occurred at Mt Whaleback mine, WA, Australia in 1983 where one hole loaded with ANFO prematurely detonated. Four years later at Mt Whaleback mine, a hole, lined with a protective sleeve that tore, was loaded with ANFO resulting in the ANFO coming into direct contact with the ground and a premature detonation occurring.

Nitrate-based blasting agents coming in contact with elevated temperature or reactive ground continues to be an issue. In 2010, Drayton mine, NSW, Australia had an incident where three persons were injured due to premature detonation of a blasting agent comprising ammonium nitrate in reactive ground with an elevated ground temperature.

Therefore, there has been a lot of development in the industry aimed at the safe operation of nitrate-based blasting agents in elevated temperature or reactive ground. A number of methods are known and used in order to inhibit the initiation of thermal decomposition of the nitrate explosive. Initially, physical barriers were used to prevent the explosive and reactive ground from coming into contact. This could take the form of sleeve liners that are inserted into the blast hole prior to loading the explosive. These liners work well when used in ideal conditions, but are prone to failure. The liners may become damaged during insertion into the borehole, or may form an inadequately-sized barrier. Furthermore, drill cuttings from the borehole on the surface are readily oxidised to substances capable of reacting with AN. It is possible for some of the blasting agent being loaded into the sleeve to fall next to the hole and interact with the drill cuttings. Therefore, there are still inherent safety risks in using such physical barriers.

Another method for making nitrate-based blasting agents safer to use in reactive ground is to include an additive in the blasting agent which inhibits the reactions, one of the most well-known additives being urea. One of the most effective means of using urea as an inhibitor is to add urea to the oxidiser phase of an explosive emulsion or water gel. Instead of forming a physical barrier, the urea chemically reacts to inhibit the thermal decomposition reaction. However, urea is limited in application as it tends to undergo a hydrolysis reaction at elevated temperatures, as well as simply hydrolysing over time. This results in the loss of protection, but also produces ammonia and carbon dioxide, posing health issues in enclosed spaces such as are commonplace on mine sites.

Methods and/or explosive compositions that aim to improve the safety of explosives, including tertiary explosives such as blasting agents, in elevated temperature ground or reactive ground are desirable.

DISCLOSURE OF THE INVENTION

According to a first aspect of the invention there is provided a method of stabilising a nitrate-based explosive used in elevated temperature or reactive ground, the method comprising the step of scavenging $NO_x$ species formed in the explosive in the elevated temperature or reactive ground in order to remove $NO_x$ as a catalyst or reagent for any subsequent chemical reaction.

The present invention seeks to address a factor in the chemical system of explosives in hot or reactive ground that has only recently become understood; the presence of nitrogen oxides ($NO_x$). The role of $NO_x$ gas in triggering the thermal decomposition of nitrate-based explosives is still not perfectly understood, but it is known that the presence of $NO_x$ acts to accelerate the initiation of the thermal decomposition of the explosive.

Therefore, it is advantageous to provide a means of substantially eliminating or at least decreasing $NO_x$ gas from the explosive chemical system. In an embodiment, at least about 80, 85, 90, 95 or 100% of the NOx is removed by the method of the invention. It is further advantageous for this means of scavenging NOx to be stable with respect to nitrate salts as used in explosives, as well as thermally stable and generally unreactive with metal sulphides or reactive ground in general.

These and other advantages may be achieved with the present invention, which in one broad form provides a method of stabilising a nitrate-based blasting agent for use within reactive ground through the addition of a $NO_x$ scavenger, which can be an agent or mixture of agents capable of substantially removing or eliminating $NO_x$ that contacts the blasting agent. The NOx scavenger is a chemical substance added in order to remove or de-activate the unwanted NOx.

The invention is based on the novel concept that if NOx species are scavenged when e.g. pyrite and ammonium nitrate (AN) react in mining boreholes, the reactions between AN and the reactive ground can be inhibited, thereby providing extra time before the AN thermally decomposes within the borehole. Thus, explosives of the present invention may be safer for use in reactive ground than existing AN blasting compositions, even if the temperature of the ground is elevated.

The present invention targets $NO_x$, which can cause generation of $HNO_2$ that subsequently acts as a catalyst to accelerate the exothermic reaction between pyrite and nitrate. A $NO_x$ scavenger can be added as a separate phase in oil, to emulsions that may already contain the optimum amount of urea in the oxidizer phase. Scavenging of $NO_x$ dissolved in the oil may delay $NO_x$ build up in the explosive, which subsequently may provide extra time before thermal decomposition of the explosive nitrate (in one embodiment ammonium nitrate). Thus, by scavenging the nitric oxides, the cycle of generation of $HNO_2$ may be broken by eliminating the root cause for its repeated generation.

The reaction between Fe(II) and nitrate does not require reactive ground such as pyrite in order to pose a problem. In some instances, the decomposition of the explosive simply occurs rapidly in hot ground (temperature >55° C.) due to temperature induced acceleration. Using a $NO_x$ scavenger in an explosive may offer the advantage of preventing or substantially reducing the accumulation of $NO_x$ in the explosive. $NO_x$ can catalyse the generation of $HNO_2$ in hot ground. Causing a reduction in thermal decomposition temperature can be dangerous in hot ground, so in addition to a $NO_x$ scavenger, urea can be added to the oxidizer phase of an emulsion to interact with the nitrate on molecular level. Urea is known to increase the thermal decomposition temperature of nitrates.

In one embodiment of the method of the present invention, the $NO_x$ scavenger is a porous solid that absorbs and/or adsorbs $NO_x$. The porosity of the scavenger can increase the surface area of the $NO_x$ scavenger available for adsorption of NOx. In an embodiment, the porous solid $NO_x$ scavenger is a zeolite. The zeolite can be Zeolite 5A, A or 4A. The porous NOx scavenger can be a molecular framework solid. The molecular framework solid can be Basolite-C300. The porous solid scavenger can be a modified clay mineral. The clay mineral can be a layered double hydroxides. In an embodiment, the porous NOx scavenging double hydroxide solid is hydrotalcite. Hydrotalcite-like structures can also be used in the method of the invention. The method also includes mixtures of porous solids.

In a second embodiment of the method of the present invention, the $NO_x$ scavenger is a transition metal oxide that reacts with $NO_x$, or otherwise catalyses its reaction. The reaction can be to produce a species that is inert (non-reactive) with respect to the nitrate-based explosive.

In an embodiment, the $NO_x$ scavenger is crystalline or amorphous manganese dioxide. The manganese dioxide can be used together with urea.

In a further embodiment of the method of the present invention, the stabilised nitrate-based explosive comprises an oil phase, and the method further comprises the step of providing the $NO_x$ scavenger in the oil phase of the explosive prior to use. This may increase the contact between the $NO_x$ and the $NO_x$ scavenger, as $NO_x$ species are known to be more soluble in hydrophobic phases.

In an embodiment of the method of the present invention, the stabilised nitrate-based explosive is a water-in-oil emulsion, and the $NO_x$ scavenger is dispersed in the oil phase of the emulsion.

In an alternative embodiment of the method of the present invention, the stabilised nitrate-based explosive comprises nitrate prills, the oil phase comprises a fuel oil, and the method further comprises the step of dispersing particles of the $NO_x$ scavenger in the fuel oil so as to bring the $NO_x$ scavenger into greater contact with the $NO_x$ species.

The method can comprise the step of hydrophobising the particles of the $NO_x$ scavenger to assist in dispersing the particles in the oil phase. The hydrophobisation can be by coating the particles in an emulsifier. The step of hydrophobising the particles of the $NO_x$ scavenger can comprise preparing a paste of the $NO_x$ scavenger. The paste can be used to form the explosive emulsion. The emulsifier can be polyisobutylene succinic anhydride (PIBSA) based emulsifier.

In an embodiment of the method of the present invention, the method further comprises the step of adding to the blasting agent one or more of urea, acid scavengers, gas bubbles, glass microballoons and polymer microballoons, in order to improve various characteristics of the blasting agent such as its explosive properties or stability, as demanded by the nature of the blasting to be undertaken.

According to a second aspect of the present invention, there is provided a blasting agent adapted for use in elevated temperature and/or reactive ground, the blasting agent comprising a nitrate-based explosive and about 1% to about 7% by weight of a $NO_x$ scavenger.

The description for the first aspect of the invention applies to the other aspects of the invention, unless the context makes clear otherwise.

In an embodiment of the second aspect of the present invention, the $NO_x$ scavenger is an inorganic $NO_x$ scavenger selected from zeolites, molecular framework, layered double hydroxides and mixtures thereof. These are believed to be capable of adsorbing and/or absorbing $NO_x$ from the chemical system, thereby potentially inhibiting the thermal decomposition of the nitrate-based explosive in the blasting agent.

In an embodiment of the second aspect of the present invention, the inorganic $NO_x$ scavenger is a layered double hydroxide. In an embodiment, the inorganic $NO_x$ scavenger is hydrotalcite.

In an embodiment of the second aspect of the present invention, the inorganic $NO_x$ scavenger is in a particulate form. In a further embodiment, the particles of the scavenger are in the range of from about 0.5 to about 50 microns in diameter. In an embodiment, the average particle size is at least about 0.5, 5, 10, 20, 30, 40 or 50 microns. The size of the particles can be measured as the equivalent diameter by light scattering.

In an embodiment, the $NO_x$ scavenger may comprise an agent that chemically reacts with $NO_x$ species so as to render NOx inert with respect to nitrate salts. By inert it is meant that NOx does not go on to react catalytically or as a reagent with other chemicals in the system. In an embodiment of the present invention the reacting $NO_x$ scavenger comprises a transition metal oxide. The metal oxide can be combined with urea. The transition metal oxide can act as a catalyst. The transition metal oxide can facilitate the decomposition of the NOx species. The transition metal oxide can be manganese dioxide. The transition metal oxide can be in either a crystalline or amorphous form. The transition metal oxide can be present together with the porous solid type of NOx scavenger. If the porous solid scavenger is saturated with NOx, the manganese oxide can provide additional scavenging.

A third aspect of the present invention provides a method of blasting, comprising the steps of determining a material to be blasted comprises elevated temperature and/or reactive ground; and charging a borehole in the material with a blasting agent comprising a nitrate salt and a $NO_x$ scavenger.

In an embodiment of the third aspect of the present invention, the blasting is carried out using a blasting agent embodying one or more of the previous aspects of the present invention.

In some embodiments, at least a portion of the borehole has a temperature greater than about 55° C. and is thus considered at least 'hot ground'. In some embodiments, at least a portion of the borehole has a temperature greater than about 130° C. and is considered 'high temperature ground'. In some embodiments of the present invention, the borehole is a wethole.

BRIEF DESCRIPTION OF THE FIGURES

Embodiments of the invention will now be described with reference to the following Figures in which.

DETAILED DESCRIPTION OF EMBODIMENTS

Figure 1:
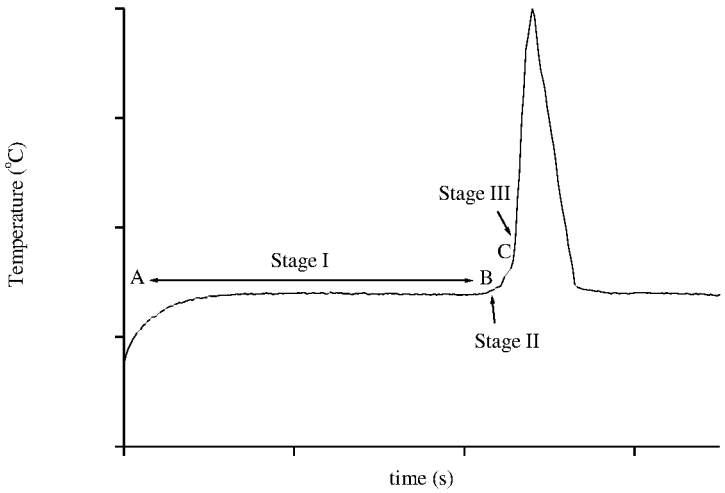
FIG. 1 is a graph showing the typical temperature versus time trace for reaction between pyritic black shale and AN. A-B is the initial stage (the induction stage or Stage 1), B-C is the intermediate stage, or Stage II. Ignition stage starts at C (Stage III).

It is well known that reactive ground comprising pyrite will naturally produce sulphuric acid and Ferrous (Fe(II)) ions; reactive ground comprising similar metal sulphides (such as cadmium or copper sulphides) will not produce ferrous ions, but will otherwise produce sulphuric acid. Given the ability for both sulphuric acid and ferrous ions to migrate through moving groundwater and other means, however, not all constituents need to be generated on-site. When a borehole in a reactive ground site is charged with a nitrate-based blasting agent, the Fe(II) and sulphuric acid in the borehole react slowly with the nitrate salts, generating $HNO_2$ and Fe(III). No significant increase in the temperature of the reaction mixture takes place during this reaction period, which is called the 'induction stage'.

Nitrate-based explosives including blasting agents (those comprising at least one nitrate salt as a major constituent of the explosive) normally start to thermally decompose from about 160° C., but in boreholes where they are in contact with pyrite and sulphuric acid, this thermal decomposition temperature can be reduced significantly. It has been determined that $HNO_2$ accumulates during the induction stage and acts as a catalyst to increase the rate of reaction between the reactive ground and the nitrate salts in an intermediate stage—the presence of nitrous acid can lower the initiation temperature of the thermal decomposition reaction.

As the concentration of nitrous acid and the system temperature rises, the thermal decomposition reaction (which occurs at a fairly low rate at typical ambient temperatures) begins to accelerate, leading to 'thermal runaway' wherein the temperature of the chemical system rapidly rises. Furthermore, a sufficient increase in temperature may lead to premature detonation of the explosive, which is an undesirable outcome in the best-case scenario and a significant safety hazard in a worst-case scenario.

Therefore, in order for blasting to be carried out safely, the length of the induction stage must be made as long as possible. It is known that nitrous acid, present due to decomposition of the nitrate salts in the explosive blasting agent, will accelerate the onset of the thermal decomposition period. However, it has now been found that $NO_x$ gas, which may also dissolve into one or more phases present in the chemical system of the borehole and nitrate-based blasting agent, performs much the same process.

Explosive/Blasting Agent

The nitrate-based explosive is provided together with a decomposition-inhibiting additive. The composition may optionally include further components, so long as those further components do not significantly detract from the properties of the blasting agent (e.g. its storage stability, handling properties and explosive properties).

The nitrate-based explosive at least partially comprises a nitrate salt and may further include a source of carbonaceous material to serve as a fuel source. There are a wide range of nitrate salts known to possess explosive properties. Ammonium Nitrate (AN) is the most well-known nitrate salt that may be adapted for explosive purposes, but further examples include sodium nitrate and potassium nitrate.

The decomposition-inhibiting additive is a $NO_x$ scavenger. The scavenger may be porous and able to adsorb or absorb NOx and/or is an agent selected for its suitability to reduce $NO_x$. The reduction of NOx can mean that the agent will preferably selectively reduce $NO_x$ and the products of any reduction reaction may be substantially inert with respect to nitrate-based blasting agents, reactive ground and/or elevated-temperature ground.

The explosive may be a blasting agent. The explosive or blasting agent may be provided in any suitable form. For example, the explosive or blasting agent may comprise a water-in-oil emulsion, a mixture of AN and fuel oil (ANFO) or a blend comprising two such blasting agents.

$NO_x$ Scavengers

A $NO_x$ scavenger may more effectively retard the reaction between metal sulphides and nitrate salts than the currently used acid neutralisers (such as zinc oxide, magnesium oxide and calcium carbonate). Acid neutralisation may give only a single level of protection through removal of acid in bore holes. However, removal of $NO_x$ is found to further inhibit the progression of the explosive chemical system towards initiation of thermal decomposition.

In the present invention, one or more $NO_x$ (i.e. NO and $NO_2$) scavengers may be used in the explosive to prevent (or at least slow down) accumulation of reactive NO and $NO_2$ in the explosive when it is in a borehole in reactive or elevated temperature ground. This removal of $NO_x$ may reduce the availability of the reactants for the thermal decomposition reaction.

In some embodiments, the $NO_x$ scavenger may be coated with a hydrophobic surfactant and directly dispersed in oil used to make nitrate-based explosives for mildly reactive grounds.

The amounts of nitrate salts and the $NO_x$ scavenger, as well as their relative proportions, in the blasting agent will depend on the conditions to which the blasting agent will be exposed in use. It is within the ability of one of ordinary skill in the art to determine these proportions based on the teachings of this specification and using field trials. In general, the blasting agent will comprise in the range of from about 65% to about 94% by weight (of the total blasting agent) of the nitrate-based explosive and in the range of from about 1% to about 15% by weight (of the total blasting agent) of the $NO_x$ scavenger. In some embodiments, the blasting agent will comprise in the range of from about 70% to about 90% by weight of the nitrate-based explosive, in the range of from about 75% to about 85% by weight of the nitrate-based explosive, or in the range of from about 80% to about 85% by weight of the nitrate-based explosive. In some embodiments, the blasting agent will comprise in the range of from about 3% to about 12% by weight of the $NO_x$ scavenger, in the range of from about 5% to about 10% by weight of the $NO_x$ scavenger, in the range of from about 1% to about 10% by weight of the $NO_x$ scavenger, or in the range of from about 7% to about 9% by weight of the $NO_x$ scavenger. In an embodiment, the NOx scavenger comprises at least about 3, 5, 7, 9, 11 wt % of the blasting agent. The amount of the scavenger in the composition should be enough to remove NOx, so that NOx is not available as a catalyst or reagent for further chemical reaction. There may be some NOx in the blasting agent that is not removed, but this may be a small amount that has no substantial on-going chemical effect.

Adsorption/Absorption-Type $NO_x$ Scavengers

The $NO_x$ scavenger may be anything that is capable of scavenging $NO_x$ species (provided it is stable with respect to nitrate-based explosives), for example by adsorbing or absorbing the $NO_x$ species (e.g. by reacting on a surface and/or bonding to a surface, etc., of a suitable $NO_x$ scavenger). Once scavenged, the $NO_x$ species are substantially prevented from taking part in any further reactions.

In some embodiments, the $NO_x$ scavenger may be an inorganic $NO_x$ scavenger. Inorganic $NO_x$ scavengers are useful as they generally do not destabilise a nitrate-containing emulsion. The scavenger can be a porous solid. Suitable inorganic $NO_x$ scavengers include, but are not limited to, the following: zeolites (e.g. Zeolite 5A, A and 4A), molecular framework solids (e.g. Basolite-C300), layered double hydroxides (e.g. hydrotalcite and other hydrotalcite-like structures) and mixtures thereof. In some embodiments, the layered double hydroxides may be calcined. Hydrotalcite (HT) has been utilised as a model $NO_x$ scavenger in the oil phase of AN emulsions, although one of ordinary skill in the art, with the benefit of this disclosure, would understand that the principles applied to HT are similarly applicable to the other porous $NO_x$ scavengers disclosed herein.

In some embodiments, the $NO_x$ scavenger may comprise particles which are capable of adsorbing or absorbing nitric oxides. The particles can be dispersed throughout any phases that may be present in the blasting agent without affecting the stability of any emulsions. The particles may have any size, provided that they are not so large as to hinder the explosive properties of the blasting agent or so small that they become too difficult to work with. The particle size range is determined as being optimum when it falls within the bounds of about 0.5 microns to about 50 microns.

It is generally preferred that a majority of the $NO_x$ scavenger be present in the fuel phase of the explosive, because $NO_x$ is more soluble in a hydrophobic phase than in water. Providing the $NO_x$ scavenger primarily in the fuel phase thereby enhances its ability to prevent the build-up of $NO_x$, in this manner inhibiting the rate of the induction reaction.

In some embodiments, the particles of the scavenger may be coated with a surfactant/an emulsifier in order to increase the particles affinity for an oil or fuel phase of the explosive. One such suitable class of emulsifiers are polyisobutylene succinic anhydride (PIBSA) based emulsifiers, which are commonly used for manufacture of emulsion explosives. Other suitable emulsifiers or surfactants include fatty acids and fatty acid amines.

It has been found that when a $NO_x$ scavenger is mixed with a solution of an emulsifier such as PIBSA, the emulsifier molecules bind to the $NO_x$ scavenger to give it a hydrophobic surface. Thus modified or hydrophobised, the NOx scavenger may be more easily dispersed in the oil phase of an emulsion, as well as in the oil phase of an ANFO.

Therefore, a NOx scavenger such as hydrotalcite mixed with a surfactant (preferably the same surfactant used to make the water-in-oil emulsion explosive) can be introduced e.g. as a paste to a pre-prepared emulsion and stirred to disperse. Using a scavenger-emulsifier paste may eliminate issues related to removing handling fine powders on an industrial scale. When the paste is introduced to the emulsion, the emulsion should have been made to the right content of oil, so that oil added with the scavenger would not make the total oil in the emulsion too high after mixing. The other advantage of using the paste is it can be easily pumped using a metering pump to fit in to continuous processes.

Introduction of the hydrophobised NOx scavenger to prilled explosive material can be done by contacting the prill with the fuel oil comprising the dispersed scavenger. This can result in modified ANFO formulations. The scavenger such as hydrotalcite is first mixed with oil containing e.g. PIBSA surfactant and then this dispersion is mixed with the prill.

Another option is to coat the NOx scavenger with a hydrophobic surfactant and then use it as dry powder to coat prill. This may be done during the manufacturing of e.g. AN. It is possible that bentonites and other powders currently used as anticaking agents could be replaced by the hydrophobised scavenger.

The hydrophobisation of the $NO_x$ scavenger may not induce crystallisation of e.g. AN in either an emulsion-type or ANFO-type blasting agent. Therefore, a combination of the $NO_x$ scavenger with an emulsifier (typically the same emulsifier agent used to make the emulsion, although other emulsifiers may be used) may be introduced on-site to pre-prepared emulsion explosives and stirred to disperse. In this manner, the $NO_x$ scavenger of the present invention may be used to adapt any pre-made explosive so as to form the blasting agent of the present invention.

Reactant-Type $NO_x$ Scavengers

An alternative to solid, porous $NO_x$ scavengers that remove $NO_x$ through adsorption or absorption are $NO_x$ scavengers that remove $NO_x$ through chemical transformation of the $NO_x$ molecule into a compound that is inert with respect to the nitrate-based explosives and/or the constituents of reactive or elevated-temperature ground.

As has been discussed, the ability of urea to function as a nitrous acid reducing agent in reality is limited due to its tendency to decompose at elevated temperatures and over time. However, it has been determined that the addition of a transition metal oxide such as Manganese Dioxide ($MnO_2$) may assist the urea to react with and reduce $NO_x$. The transition metal oxide can assist by catalysing the reduction of $NO_x$ by urea, although it may be that at least some or all of the $MnO_2$ is consumed by the reaction. In this manner, the unique and novel system of urea with a $MnO_2$ catalyst or promotor may permit urea to reduce both nitrous acid and $NO_x$. This may subsequently lead to a greater rate of consumption of urea, limiting the decomposition of urea into ammonia. Furthermore, any ammonia that is produced will also (in conjunction with $MnO_2$) catalytically reduce $NO_x$ gas, further serving to inhibit the thermal decomposition of the nitrate salts within the blasting agent.

The $MnO_2$ may be used as either a catalyst or promotor in either a crystalline or amorphous form. The optimum size range of metal oxide particles can be in the range of from about 10 to 20 microns in average diameter. It has been found that in embodiments, that manganese dioxide does not induce crystallisation when used in an emulsion explosive.

Other Additives

In some embodiments, the explosive or blasting agent may further comprise other components, such as urea, gas bubbles, glass or polymer microballoons, or mixtures thereof. These additional components can impart further advantageous properties, as may be required for specific applications (e.g. where the ground is more reactive or hotter than usual).

Urea increases the thermal decomposition temperature of nitrate salts in contact with metal sulphide ores and also reacts with nitrous acid when in contact with bore water of low pH. Thus, depending on the acid, Fe(II) and moisture contents of the ground and reactivity of rocks at the blasting site, adding an amount of urea to the blasting agent may even further prolong the induction stage. An optimum amount of urea in the blasting agent increases the thermal decomposition temperature of the nitrate salt in contact with the metal sulphides and scavenges existing $HNO_2$ at the reaction sites at low pH.

In embodiments, the blasting agent of the present invention comprises a water-in-oil emulsion, and/or a mixture of AN and fuel oil (ANFO). The water-in-oil emulsion can comprise a water immiscible hydrocarbon fuel as the continuous phase and a dispersed aqueous droplet phase containing supersaturated ammonium nitrate (this dispersed phase is referred to as the 'oxidizer phase'). The dispersed droplets may be stabilized in the continuous phase using a suitable emulsifier (e.g. PIBSA or Sorbitan Mono Oleate (SMO)).

In addition to the nitrate droplets, fine particles of the decomposition-inhibiting additive can be dispersed in the oil phase. This particle phase can be about 1 to about 10% by weight in the blasting agent.

Depending on the ground reactivity and temperature, urea may also be introduced to the oxidizer phase at up to about 5, 8, 10 wt % to increase the thermal decomposition temperature of the nitrate-based blasting agent in the presence of metal sulphides and to retard the reaction of nitrates with sulphides. The decomposition-inhibiting additive in the continuous oil phase may contribute to the inhibitory action of the urea, and may significantly increase the time to thermal decomposition of AN compared to the corresponding blasting agent containing only urea.

In situations where the urea adversely impacts on the fragmentation energy of the explosive, the urea content may be kept at a suitably low level and the required inhibitory effect may be achieved by increasing the amount of NOx scavenger, e.g. HT, in the oil phase. Thus the blasting agent can be provided with reaction inhibitors in the continuous oil phase and the dispersed oxidizer phase, which complement each other and give two types/levels of protection against the reaction of AN with pyrite and it's weathered products. The blasting agent may be sensitized by chemically generating gas bubbles in the emulsion or adding glass/polymer microballoons. Moreover, in wet blast holes, urea prills in ANFO may be replaced with HT, which is insoluble in water.

Method of the Present Invention

The present invention also relates to a method for prolonging an induction stage of reactions which occur when a blasting agent comprising ammonium nitrate is exposed to reactive ground. The method comprises adding a decomposition-inhibiting additive to the blasting agent. The additive is a NOx scavenger.

The blasting agent used in the method of the present invention may be the same as the blasting agent described in detail above. The blasting agent may be prepared using techniques known in the art, which depend on factors such as the type of blasting agent (e.g. nitrate emulsion/ANFO etc.) and its intended use.

As noted above, $NO_x$ is more soluble in oil than in water. As such, in embodiments where the blasting agent comprises a water-in-oil emulsion, the decomposition-inhibiting additive would usually be added to the oil phase of the emulsion. The decomposition-inhibiting additive may be added to the oil phase at any suitable time (either before, during or after formation of the emulsion). Similarly, in embodiments where the blasting agent comprises a mixture of ammonium nitrate and fuel oil, the decomposition-inhibiting additive would usually be added to the fuel oil. The decomposition-inhibiting additive may be added to the fuel oil at any suitable time (either before, during or after formation of the ANFO).

In embodiments where the decomposition-inhibiting additive is at least partially particulate, the particulate portion of the decomposition-inhibiting additive may be coated with a binding agent prior to mixing with the blasting agent in order to strengthen the binding between the particles and the nitrate prills, or to improve the stability of the emulsion.

In some embodiments, the decomposition-inhibiting additive is added to the blasting agent at the blast site. For example, a mobile processing unit configured to manufacture the blasting agent may be modified to mix the decomposition-inhibiting additive with an emulsion matrix and/or ANFO mixture. The present invention also relates to methods of blasting. The methods comprise determining whether a material to be blasted comprises reactive ground and charging a borehole in the material with a blasting agent comprising ammonium nitrate and a decomposition-inhibiting additive. The methods may be used with wet and/or hot boreholes (e.g., >55° C., including boreholes hotter than the decomposition temperature of urea, about 130° C.).

EXAMPLES

Described below is the chemical background and experimental data in support of the hypothesis that NOx removal is advantageous. The Examples describe explosive blasting agents tested according to various methods. The examples are intended to exemplify embodiments of the invention, but the invention is not so limited to the reagents, amounts and ratios used herein.

Materials and Methods

Several sources of pyrite were used. RG1 was supplied by Dyno Nobel and is a reactive grade ground sample containing ~2.50% by weight of adsorbed water, and a pyrite content of less than 30 wt %. The remaining material is a mixture of clays, quarts and organic matter. The particle size was less than 50 microns on average.

Pure pyrite (PY) was obtained from Spectrum Chemicals and is 100% oxidized pyrite with a grain size of 200-400 microns. The pyrites were used as received unless noted otherwise. In some cases it was washed with water to remove residual salts, and then dried at 100° C.

Ammonium nitrate, AN, (Acros Organics, 99+%) was used as received but was ground in a mortar and pestle prior to use to break up any large clumps. Dodecane (Sigma, ≥99%), iron(II) sulfate 7 hydrate (BDH, >99.5%), iron(III) sulfate 5 hydrate (Fluka), urea (Ajax chemicals, 99.5%), hydrazinium sulfate (Ajax chemicals, >99.5%), Kaolin (Kaolin Australia, Pty Ltd, Eckafine BDF), Hydrotalcite (Sigma) and Basolite C300 (BASF) were used as received. Sodium nitrite (Mallinckrodt), diacetyl monoxime, DCM (Fluka), thiosemicarbazide, TSC (BDH), phosphoric acid (85%, Ajax Finechem Pty. Ltd), sulfuric acid (96%, Ajax Finechem Pty. Ltd), and iron (III) chloride 6 hydrate (Merck), PIBSA-DEEA (Clariant) were also used as received.

Urea Determination

Urea was determined by UV-vis spectroscopy at a wavelength of 525 nm using diacetly monoxime, DCM and thiosemicarbazide, TSC.31 An acidic ferric solution was made containing phosphoric acid (100 ml), sulfuric acid (300 ml, water (600 ml) and ferric chloride (0.10 g). DCM and TSC were mixed (0.50:0.01 g) and made to volume (100 ml). When ready to use, the chromogenic reagent containing the acid solution (2 parts) and DCM/TSC solution (1 part) were mixed. Urea stock solutions were prepared containing ~20 ppm urea.

Standard urea solutions were prepared by diluting stock urea solutions in water. The urea solution (0.32 ml) was mixed with the chromogenic solution to 10 ml, covered in aluminum foil and heated in boiling water for 10 minutes. The sample was cooled rapidly in ice and the UV-vis spectrum was measured from 400 to 600 nm.

Six samples containing 5 wt % urea (based on AN), ammonium nitrate (0.9 g), reactive ground 1 (0.9 g) and weathering solution containing dissolved urea (0.245 g) were prepared and placed in 2 thermos flasks and heated to 55° C. in a sand bath. Samples were removed at selected time intervals, the first after 5 minutes and the last after 20 days. The samples were quenched with water (8.4 g) and the pH measured. More water was added (30 g total) and the slurry was then filtered through a 0.2 micron filter in a 50 ml volumetric flask containing a drop of concentrated sulfuric acid. The solution was further diluted (1.0 ml into 50 ml) and 0.32 ml was pipette into 10 ml volumetric flasks to which was added the chromogenic solution to volume. The sample was heated as before and cooled then the UV-vis spectrum measured from 400-600 nm.

Weathering Solution

Synthetic weathering solution was freshly made containing iron(II) sulfate 7 hydrate (0.245 g), iron(III) sulfate 5 hydrate (0.50 g), and water (3.3 g). The mixture was gently sonicated until fully dissolved. In a typical experiment, 0.2 g of this solution is used.

pH Measurements

Mixtures of reactive ground (RG1), ammonium nitrate (AN), and weathering solution (WS) were reacted (0.9:0.9:0.2 g) in small glass vials and heated in a water bath at 55° C. for 5 minutes. After this time the sample was quenched with ~6.5 g water and the pH measured. In some cases, the heating temperature was 80° C.

NO Adsorption

Reactive ground was mixed with AN, and WS (0.9:0.9:0.2 g) and placed in the bottom of a small 5 ml glass tube. Potential inhibitors (scavengers) were physically separated from the reactive mixture so that they were only in contact through the gas phase. The solid inhibitors were dispersed in dodecane (~40 wt %), and ~0.7 g mixture was used. The reactive mixture was heated and mixed until a uniform paste was achieved, then added to the bottom of the reaction tube.

A polyethylene foam support cut to size was then placed half way up the tube on which was placed a glass fibre filter disc (250 micron pore size) cut to size. The inhibitors were placed on top of this filter to prevent them from being in direct contact with the reactive mixture. The filter served to prevent small particles from falling into the reactive mixture and inhibiting the reaction on contact. We tested kaolin along with zeolite A and hydrotalcite. A blank was made by adding a similar quantity of dodecane to the glass filter.

The reaction tubes were closed with a plastic cap containing a small pin hole and immersed in a water bath at 55° C. The reaction began when the first visible sign of brown NO2 began to form.

NOx Analysis

The build-up of NOx during Stage I and into Stage II was determined with a Kane, Quintox flue gas analyser. Four duplicate samples were prepared to which were added reactive ground, ammonium nitrate and water (0.9:0.9:0.2 g) in 16 mm (i.d.), glass test tubes (15 cm long). The samples were sealed with a rubber stopper and heated in a water bath at 55° C. At designated time intervals, each sample was analysed for NO and NO2 in the headspace above the sample, then continued to be heated. Some samples was sampled for gas up to 10 times prior to the end of Stage I, whilst other samples were only analysed once or 3 times.

IR Spectroscopy, UV-Vis and XRD

IR spectra were recorded with a Bruker Tensor 27 spectrophotometer using the DRIFTS method between 400-4000 cm-1 using KBr as background. Mixtures of AN and PY were also made and the IR spectra measured using AN as a background.

UV-vis absorbance spectra were recorded with a UV-vis spectrophotometer (Cary 1E) between 200-700 nm.

The x-ray diffraction data were collected with CuKa radiation using a X'Pert Pro diffractometer (Pan analytical). The copper source was run at 45 KeV and 45 mA and measured between 5-90°.

General Emulsion Manufacturing Procedure

The nitrate-based-explosive-containing emulsions described in the Examples set out below were manufactured using the following general method. The ingredients of the oxidizer phase were heated to 75° C. to form an aqueous solution. Separately, the ingredients of the fuel phase were mixed while heating to 65° C. The hot oxidizer phase was then poured into the fuel phase slowly, with agitation provided by a Lightnin' Labmaster™ mixer fitted with a 65 mm Jiffy™ stirring blade rotating initially at 600 rpm for 30 seconds. The crude emulsion was refined by stirring at 1000 rpm for 30 seconds, 1500 rpm for 30 seconds and 1700 rpm until the stated viscosity was achieved. The quantity of product prepared in each sample was 2.00 kg.

Isothermal Testing Procedure

The Isothermal Testing Procedure referred to in the Examples set out below has been developed by the Australian Explosives Industry Safety Group (AEISG) and adopted by Australian explosive suppliers for determination of reactive ground (AEISG Code of Practice, Elevated Temperature and Reactive Ground, Edition 3, June 2012).

Ground samples are crushed and screened to 250 um. 18 g of the crushed and screened material is weighed into a clean dry tube, along with 18 g of the product and 4 g of weathering solution. The weathering solution consists of 2 g of a 13.6 wt. % ferrous sulphate solution and 2 g of a 38.5 wt. % ferric sulphate solution. All the components are mixed together and the open end of the tube enclosed with aluminium foil.

The glass tubes are placed into an aluminium block set at the required temperature. The aluminium foil is pierced with a thermocouple temperature probe which is placed into the mixture. The tube remains in the aluminium block until the sample reacts or 28 days, whichever occurs first.

A reaction is considered to occur when there is observed to be an exotherm of 2° C. or more and induction time is taken to be the commencement of the testing to the peak maximum.

Adiabatic Testing Procedure

The Adiabatic Testing Procedure referred to in the Examples set out below will now be described. Heat dissipation from a reacting region in a blast hole depends on the thermal conductivity of the surrounding rocks, which can be very limited depending on the type of the rocks. Therefore the worst case scenario of the self-heating phenomenon must occur under a semi-adiabatic condition rather than an isothermal condition. Considering this practical aspect, the inventors designed a semi-adiabatic calorimeter to evaluate the effectiveness of the inhibited blasting agents. The temperature rise due to the reaction between pyrite and ammonium nitrate was monitored by heating the reactants in this semi-adiabatic calorimeter.

The calorimeter was made using a 350 ml stainless steel vacuum travel bottle (Wellsense). A hollow cylinder with wall thickness of about 1.2 cm was made using ceramic insulation paper purchased from Mathews Industrial Products PTY.LTD (2 mm FT paper, Thermal conductivity approx. 0.08 W/mK). The outer diameter of the cylinder was about 6 cm and height was about 11 cm. The ceramic paper was wrapped with a thin Teflon insulation tape before rolling to give the cylinder a smooth cleanable surface. This cylinder was inserted into the travel bottle. A ceramic disk of about 0.8 cm thickness, which was also wrapped with the Teflon tape was placed at the bottom of the flask. The samples were kept in a thin walled Pyrex tube (diameter=1.1 cm) in the flask.

The purpose of the ceramic insulation was to prevent heat transfer from the heating tube to the metal wall of the flask via circulating convection currents during rapid self-heating of the sample. A lid was also made using the same ceramic paper. This ceramic lid had a hole of about 2 mm diameter and was loosely kept on the mouth of the flask to allow $NO_x$ to escape without pressurising the flask. The mouth of the reaction tube (Pyrex) was loosely blocked using a piece of the ceramic paper so that it can pop out during rapid evolution of $NO_x$.

A thin stainless steel coated type K thermocouple (sheath diameter approx. 0.05 mm) was placed in the middle of the sample or strapped to the heating tube using a Teflon tape. The thermocouple was connected to a data logger (Omega OCTTEMP 2000), which was connected to a computer for online recording. The calorimeter was heated to the desired initial temperature (normally to 55° C.) by placing it in a temperature controlled water/glycerol bath. In some experiments the Pyrex tube containing the reaction mixture was directly connected to a syringe (60 ml) using a Teflon tube to prevent the escape of $NO_x$ and moisture, and also to prevent build-up of pressure in the tube during the reaction. This semi adiabatic calorimeter allowed the inventers to evaluate inhibited blasting agents by using samples as small as 5 g. The calorimeter can be scaled up to test larger reactive ground samples if required.

The stability of the explosives tested in the presence of reactive ground can be evaluated by heating a mixture of pyrite, its weathered products and the blasting agent. The heating may be done isothermally or adiabatically. The isothermal methods are easier to perform and therefore are normally used in industry. However, adiabatic methods are thought to provide the closest approximation to the field conditions.

Chemical Background

Ammonium nitrate decomposes in an exothermic reaction to produce three moles of gaseous products for each mole of solid reactant:

$$NH_4NO_3(s) \rightarrow N_2O(g) + 2H_2O(g) \quad (1)$$

The reaction can be made more exothermic, with more gaseous products, if some oxidisable fuel is added:

$$2NH_4NO_3(s) + C \rightarrow 2N_2(g) + 4H_2O(g) + CO_2(g) \quad (2)$$

Hence the standard ammonium nitrate explosive mixture is termed ANFO, for an "ammonium nitrate fuel oil" mixture. The decomposition temperature of pure ammonium nitrate is 170° C., but recently it has been found that an intimate mixture of ammonium nitrate and pyrite can decompose at temperatures as low as 50° C. in blast holes more than 0.2 m in diameter. This is consistent with many field observations of detonations at low ambient temperatures. The same initial reactions occur in acid mine drainage, which has been extensively studied. Parallels can be made between the two processes and analogies usefully drawn. Water is required in both cases, implying that soluble species are involved.

The first step in the process is the oxidation of pyrite by air. The oxidation product of the sulfur could be various substances such as $SO_2$, $SO_3$, thiosulfate, etc. For illustrative purposes $SO_2$ is chosen because it is detected as a product in reactive ground environments; however, this choice does not affect the conclusions of the argument. For example, oxygen from the air oxidizes the disulfide anion to $SO_2$:

$$2FeS_2+5O_2+4H+\rightarrow 2Fe_2++4SO_2+2H_2O \quad (3)$$

The Fe(II) is further oxidised to Fe(III), which precipitates as the insoluble hydroxide in near neutral pH solutions.

$$2Fe_2++5H_2O+\tfrac{1}{2}O_2\rightarrow 2Fe(OH)_3+4H+ \quad (4)$$

The sum of these two reactions neither consumes or produces protons $$2FeS_2+5\tfrac{1}{2}O_2+3H_2O\rightarrow 2Fe(OH)_3+4SO_2 \quad (5)$$

but the $SO_2$ is readily soluble in water to produce sulfurous acid, with pKa1 of 2.

$$SO_2+H_2O\rightarrow H++HSO_3- \quad (6)$$

Both of the oxidation reactions above are relatively slow but, as they proceed and the acidity increases, some of the $Fe(OH)_3$ begins to dissolve. It turns out that the oxidation of pyrite by Fe(III) is very much faster than by oxygen.

$$FeS_2+10Fe_3++4H_2O\rightarrow 11Fe_2++2SO_2+8H+ \quad (7)$$

The process now becomes autocatalytic, as more acid is produced and more Fe(III) dissolves. The rate-limiting step in this inorganic cycle then becomes the oxidation of Fe(II) to Fe(III) by oxygen, but in the field this is accomplished rapidly by bacteria. In mine sites where bacteria are present, pH values can range from 0.7-3.08 and ferric (Fe(III)) concentrations from 1-20 g/L.

The thermal profile of the decomposition process comprises three stages: an induction period, an intermediate stage and the final highly exothermic decomposition. (FIG. 1) The reactions described above could explain the observation of the induction period in the thermal decomposition of ammonium nitrate explosives caused by reactive ground. Some preliminary studies have indicated an inverse correlation between initial acidity and the induction time. According to some authors, acid accelerates the rate of the initial stage and has little or no effect on the intermediate stage. The initial stage of the process is interpreted as the slow reduction in pH until the rapid and exothermic oxidation by Fe(III) accelerates.

The preferred method of controlling both acid mine drainage and reactive ground has been to maintain a high pH through the use of alkaline substances. The use of solid bases such as limestone is not effective, however, for the Fe(III) precipitates on the surface and passivates the remaining solid base, a process termed 'armouring', rendering it ineffective.

Accordingly, the use of urea is preferred which homogeneously generates the weak bases ammonia and carbonate by hydrolysis and hence consumes protons (Eqn. 8)

$$CO(NH_2)_2+2H++2H_2O\rightarrow 2NH_4++H_2CO_3 \quad (8)$$

There is compelling empirical evidence in the industry that urea is an effective inhibitor of the thermal decomposition of AN in reactive ground. The mechanism of this inhibition is uncertain. The hydrolysis of urea is known to be a slow reaction, which proceeds at a rate that is independent of pH. The length of the induction period could be limited by the total consumption of the urea. Alternatively, if the rate of acid generation is greater than the rate of urea hydrolysis, then the pH of the system could slowly drop, despite the partial neutralisation by the urea hydrolysis, until it reaches an acidic condition that allows an autocatalytic runaway decomposition. Finally, the urea could act as an inhibitor by a mechanism not involving its acid-base chemistry.

Tests of the Acid Neutralisation Hypothesis

Figure 2:
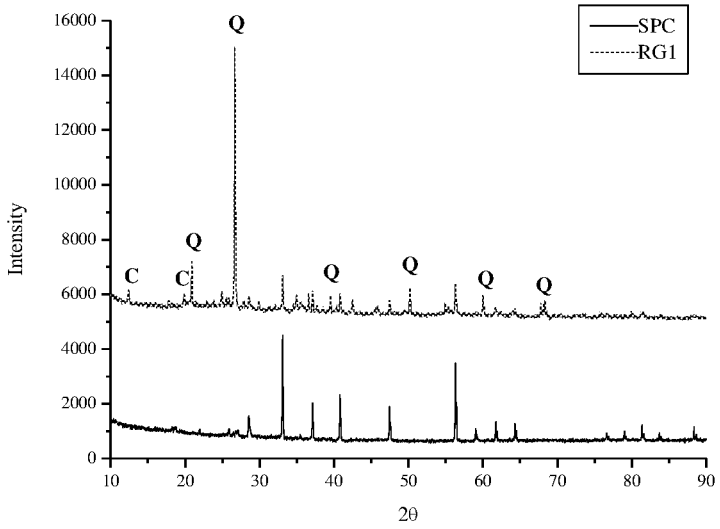
FIG. 2 is an XRD spectrum of pure pyrite and reactive ground.
Figure 3:
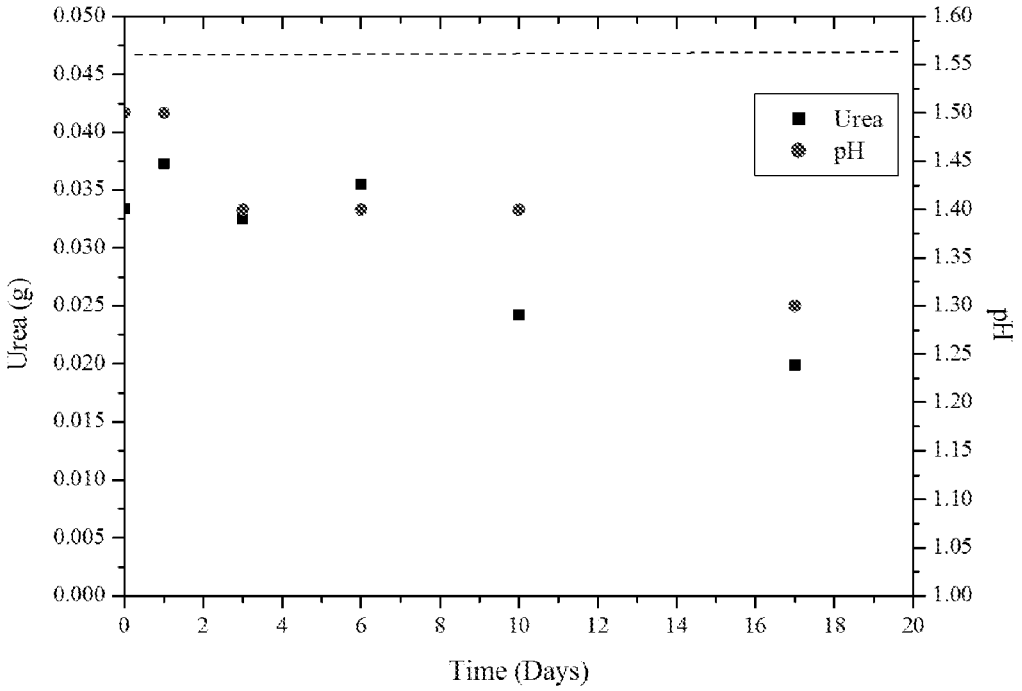
FIG. 3 shows a change in urea concentration and pH with time for Reactive ground 1, AN, and WS mixtures containing 5 wt % urea and heated at 55° C. The end of the induction time has not been reached.

Reactive ground and pure pyrite was used and characterized by XRD (FIG. 2). The reactive ground sample contained mixtures of minerals consisting predominantly of quartz (Q), with some clinochlore (C) as well as some pyrite mineral. The spectrum pyrite consisted of 100% pyrite. Six reactions containing ammonium nitrate (AN), reactive ground (RG 1) and weathering solution (WS) with 5 wt % urea were prepared and sampled every few days. After quenching the samples with water the pH was measured and the total urea analysed by UV-Vis. The results are shown in FIG. 3.

During the course of 17 days of the inhibition of the reaction the consumption of urea was only partial; the urea decreased from an initial mass of 0.046 g to ~0.02 g. At the same time the pH of the slurry decreased from 1.5 to 1.3.

If urea were hydrolysing to produce base then the pH should be greater than 1.3 after this time.

Similar results were found at lower urea concentrations; with 0.2 wt % the urea deceased by one-third prior to the decomposition process at the end of the induction period. Over the course of 25 days at room temperature no significant change in pH was found in near neutral solutions of 17% urea in water or in 60% AN in water. It is concluded that the hydrolysis of urea is too slow to neutralise acid significantly and that the presence of excess urea does not increase the hydrolysis rate. This is consistent with literature reports that the hydrolysis reaction is slow, with a rate constant of $8.4\times10^{-10}sec^{-1}$ at 25° C.

Identification of NO Product

Preliminary studies were conducted in a glass reaction cell which was placed on a microscope hot stage at 55° C. An interface was formed between reactive ground (RG 1) and an AN emulsion. The initial stages of the reaction were directly observed using a video microscope. Gas bubbles form rapidly in the sample after an induction period of about 20 minutes when the emulsion had no inhibitor. The colourless gas in the bubbles immediately became brown when it came to contact with $O_2$, indicating that it was nitric oxide.

Figure 4:
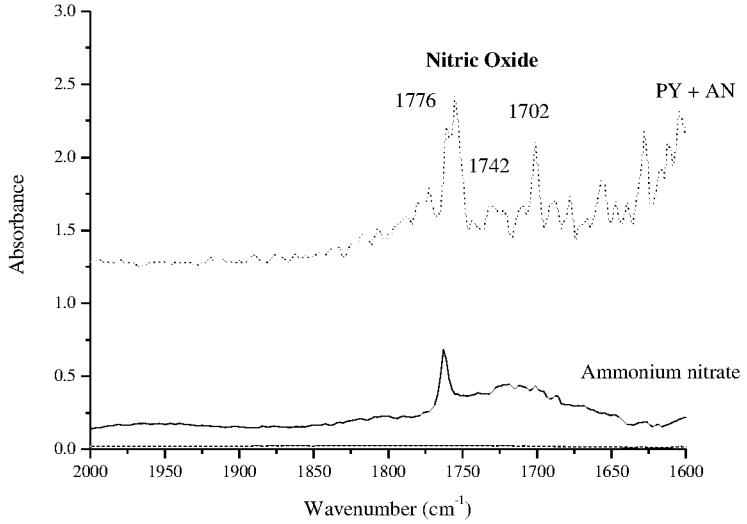
FIG. 4 is graph showing an IR spectra of ammonium nitrate, pyrite, and mixtures of AN and PY.

The IR spectra of ammonium nitrate, pyrite and mixtures of AN and PY are shown in FIG. 4. Bands due to the generation of surface bound NO species are seen in the region 1750-1800 cm−1. The presence of the vibrational mode at 1776 cm−1 is due to the stretching vibration of N═O of adsorbed NO. To confirm the initial formation of NO as the precursor to NO2 gas Reactive ground (RG1) and AN were reacted in the presence of ~2% water. The sample was mixed and then sealed with a rubber septum and placed in a water bath at 55° C. for 1 hour. Oxygen was generated by mixing permanganate ions with peroxide and collecting the gas in a syringe. The oxygen gas was then injected through the rubber septum. Brown $NO_2$ formed immediately in the vial. The NO gas was even formed at room temperature by mixing equal amounts of reactive ground and AN in the absence of additional water and capping the sample.

After ~1 hour when the cap was removed a clear gas was discharged that turned brown on exposure to air.

Further experiments were conducted in reaction tubes maintained at 55° C. in a water bath. The induction time was taken as the time at which the first indication of brown gas was evident above the slurry. This point (end of Stage I) closely coincided with an expansion of the sample volume by a factor of ~2 (start of Stage II). After this initial expansion the volume further increased by ~4 times with the evolution of more dark brown gas (Stage II). Stage III began when the volume increased further with violent bubbling, followed by vigorous evolution of dark brown gas, and sometimes accompanied by thick white smoke. The presence of inhibitors generally reduced the severity of Stage II (and III) and extended its length. In such cases, the induction time was still taken as the time at which brown $NO_2$ gas was initially evolved, despite the runaway being further delayed.

Figure 5:
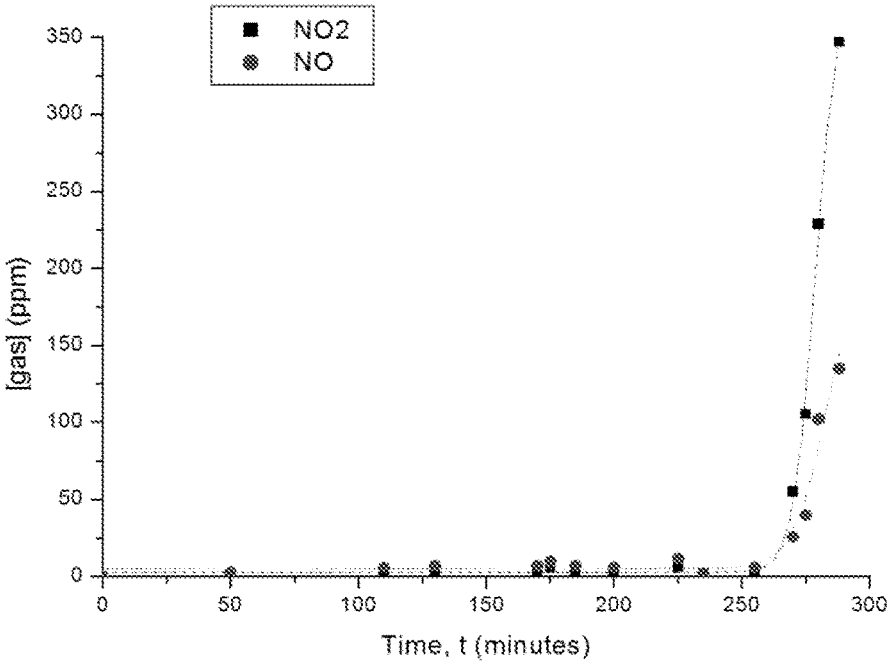
FIG. 5 is a graph showing NO and NO2 observed by sampling the atmosphere above the reaction mixture containing AN, RG 1 and WS at 55° C. The start of Stage II occurs after ~260 minutes.

To measure the formation of NO directly, instead of observing its oxidation to brown $NO_2$, a combustion gas emissions monitor was employed. The reaction was conducted at 55° C. in a water bath, with the gas atmosphere withdrawn for measurement at each data point. This removal of the gas atmosphere also inhibits the reaction, which reached Stage II only after four hours when sampled 10 times throughout the induction period, but when NO was not removed the induction time was only ~100 minutes. The results indicate that the accumulation of NO remains low, at least in the gas phase, until the end of the induction period (FIG. 5), when it forms in quantity accompanied by $NO_2$.

Inhibitors (Scavengers) and NO

The results described above suggest that the decomposition of AN occurs in the presence of NO, but that NO and $NO_2$ only accumulate significantly at the end of the induction stage, but its removal delays the reaction.

To test this inference the standard reactive ground test with AN, RG 1 and WS was performed but with potential inhibitors physically separated from the reactive mixture so that they were only in contact through the gas phase. The solid inhibitors were dispersed in oil containing surfactant to simulate the actual condition inside a water-in-oil emulsion. This test was designed to see whether the gas formed during the reaction contributed catalytically to the reaction and if so which materials could selectively adsorb it to increase the induction time.

The reactive mixture consisting of RG 1, AN, and WS was heated and mixed until a uniform paste was achieved, then added to the bottom of the reaction tube. A polyethylene foam support cut to size was then placed half way up the tube on which was placed a glass fibre filter disc cut to size. The inhibitors were placed on top of this filter to prevent them from being in direct contact with the reactive mixture. The filter served to prevent small particles from falling into the reactive mixture and inhibiting the reaction on contact. Since particulate inhibitors would be present in the oil phase of an emulsion the inhibitors were dispersed in dodecane to make a thick paste, which was placed on the top of the filter. Kaolin, zeolite A and hydrotalcite were used. A blank was made by adding a similar quantity of dodecane to the glass filter.

The reaction tubes were closed with a plastic cap containing a small pin hole and immersed in a water bath at 55° C. After 71 minutes of heating the zeolite A sample had already reacted, and the kaolin was beginning to react along with the blank as indicated by the evolution of brown $NO_2$ gas. Finally, after 130 minutes the hydrotalcite sample began to react. Photos were taken at selected time intervals and the extent of reaction noted. The slight differences in times between blanks and inhibitors were due to slightly different amounts of inhibitor and oil present initially as it was difficult to add exactly the same quantities of each.

The only mechanism for inhibition in these systems is gas adsorption since the inhibitors were not in contact with the reactive mixture, but separated by some distance. Since there is no water present in the inhibitor the nitric oxide remains as a dissolved gas and does not produce nitrous acid to any significant extent. In the absence of any inhibitor the decomposition reaction is expected after about 20 min. The increase in the induction time in the presence of dodecane to 71-90 min indicates that gas adsorption occurs into the oil phase with a significant solubility. It is well known that nitric oxide has a much greater solubility in oil than in water. The oil-dissolved NO apparently does not then participate in the AN decomposition reactions.

Figure 6:
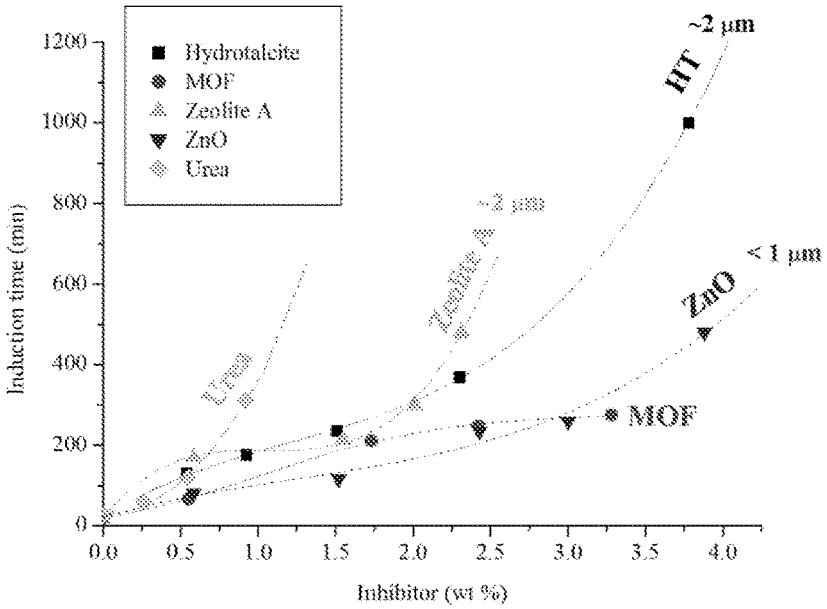
FIG. 6 shows the Induction time of particulate inhibitors present in the reactive mixture of RG 1, AN, and WS after heating at 55° C. for the given times.

Selected inhibitors, which now included a metal/organic framework (MOF, Basolite C300) and urea, were then heated with reactive ground, AN and WS at 55° C. (FIG. 6) to demonstrate inhibition by NOx removal compared to acid neutralisation.

Proposed Mechanisms

Mechanisms can now be advanced for the multiple roles of inhibitors of the decomposition of ammonium nitrate.

Pyrite and/or Fe2+ react with the nitrate ion to form NO. In the presence of NO3− and acid some of the dissolved NO will form $HNO_2$ through the reversible equilibrium (Eqn 12) or by the oxidation with molecular dioxygen (eqn 13).

$$H_2O+2NO+H^++NO_3^- \Leftrightarrow 3HNO_2 \quad (12)$$

$$4NO+O_2+2H_2O \Leftrightarrow 4HNO_2 \quad (13)$$

NO is a powerful auto catalyst which accelerates the reaction between pyrite and nitrates. (The autocatalytic and rate enhancing power of NO has been utilized to extract valuable metals trapped within sulphide minerals as inclusions by annihilating the sulphide lattice through rapid oxidation.)

When NO is dissolved in water and converted to $HNO_2$, it can be reduced by urea to produce $N_2$ and $CO_2$ at low temperatures (5-60° C.).

$$2HNO_2+NH_2CONH_2 \rightarrow 2N_2+CO_2+3H_2O \quad (14)$$

Since at low acidity levels $HNO_2$ decomposes to form gaseous NO, the urea oxidation process is carried out at pH of about 1 to prevent the decomposition. As pH increases above 2 the efficiency of the process decreases sharply. Therefore, when emulsions are used, the urea in the emulsion droplets (at pH~5) does not scavenge NO diffusing into them via the oil phase of the emulsion.

Implications

The active species for the decomposition appears to be $HNO_2$, with a pKa of ~2.818, but not the nitrite ion $NO_2$—. The nitrous acid is formed from NO, so sequestering this species provides another means of inhibition. Hydrotalcite appears to work by this mechanism, and other modified clay minerals could be effective. Sequestering NO only provides a reservoir which ultimately can become saturated. A permanent solution is the decomposition of the nitrous species to inert $N_2$ and $H_2O$, which can be effected by urea. Under condition of moderately low temperature (<~60° C.) urea acts as an inhibitor by scavenging nitrous acid, not by slowly hydrolyzing to produce base, as originally suggested. The kinetics of this reaction is likely to determine the sleep-time of an inhibited product and is the subject of future work.

The following examples focus on examples of various NOx scavengers in order to exemplify embodiments of the invention.

Example 1

An emulsion containing 74.3 wt % AN, 4.9 wt % urea, 14.4 wt % water and 6.3 wt % oil phase was made. The oil phase used was a mixture of 15 wt % PIBSA emulsifier and 85 wt % diesel fuel oil. This emulsion was used as the standard emulsion for this Example.

Hydrotalcite (HT) purchased from Sigma was calcined at 550° C. for 4 hours. The calcined HT was wetted with a hydrocarbon mixture containing 15 wt. % PIBSA emulsifier. This HT-oil mixture contained 33.3% oil phase (including emulsifier). This oil coated HT was then mixed with the standard emulsion to make an inhibited emulsion containing 4.65 wt % HT by weight.

The standard and HT added emulsions were then tested in accordance with the standard system isothermal test at 130° C. using ground samples from Newman, Western Australia. The period from when the sample was added to the heating block and the maximum of temperature raise is considered the induction time.

Addition of HT increased the induction time from 3.5 hours for the standard emulsion to 42 hours for the HT added emulsion.

Example 2

An emulsion containing 72.93 wt. % AN, 1.54 wt. % urea, 19.6 wt. % water and 5.92 wt. % oil phase was manufactured. The oil phase used contained 65 wt. % dodecane, 14 wt. % PIBSA DEEA emulsifier and 21 wt. % diesel. This emulsion was used as the standard emulsion for this Example.

Uncalcined HT was then mixed with the same oil phase (containing 14 wt. % PIBSA DEEA emulsifier) to make a mixture containing 71.3 wt. % HT. This oil coated HT was then well mixed with a portion of the standard emulsion to make an emulsion containing 1.2 wt. % HT.

The standard emulsion and the HT added emulsion were tested for induction periods at 55° C. in a closed system adiabatic calorimeter. In brief, the test samples (about 4.7 g and done in duplicate) were prepared by mixing samples of the standard and the HT added emulsions with pure pyrite purchased from Spectrum. The pyrite was wetted with a solution containing Fe(II) and Fe(III) ions according to the AEISG Code, respectively. This solution, which represented weathered products of pyrite, was made by dissolving Fe(II) and Fe(III) sulphates as described in the isothermal testing procedure. One gram of the solution was mixed with 4.5 g of pyrite. The samples were then separately held at 55° C. in an adiabatic calorimeter while continuously recording the sample temperature, until an exothermic reaction occurred. The heating period up to the exotherm was taken as the induction time. Addition of HT increased the induction time from about 6.8 days for the standard emulsion to 17 days for the HT added emulsion.

Example 3

An emulsion containing 70.7 wt. % AN, 19.9 wt. % water and 9.9 wt. % oil phase was prepared. The oil phase used was dodecane containing 10.6% PIBSA DEEA1100 emulsifier and 16% diesel. This emulsion was used as the standard emulsion for this Example.

A sample of Hydrophobic HT, (purchased from Sigma) (0.05 g) was mixed well with a portion of the emulsion (10 g) to make a HT added emulsion, which finally contained 0.50% HT. (This hydrophobic HT was not wetted with PIBSA before addition to the emulsion).

The reference emulsion and the HT added emulsion were tested for induction periods at 55° C. The test samples were prepared by mixing the emulsions with reactive ground received from Dyno Nobel, according to the isotherm test method. The samples (neat emulsion+reactive ground and HT added emulsion+reactive ground) were then held at 55° C. using the adiabatic calorimeter until reaction occurred.

It was found that addition of 0.50% HT to the neat emulsion increased the induction time from 17 min to 135 min.

Example 4

A mixture containing AN crystals (89.9 wt. %), oil (7.5%) and calcined HT (2.45%) was prepared by first mixing the required amount of calcined HT in dodecane containing 14 wt. % PIBSA DEEA emulsifier and then adding AN crystals to this oil-HT mixture. This mixture was used to prepare an AN-oil-HT-emulsion mixture containing 30 wt. % emulsion. The composition of the emulsion used was 2 wt. % urea, 69.56 wt. % AN, 11.6 wt. % (oil+PIBSA), 17.3 wt. % water. A reference mixture was also made by mixing AN-Oil and Emulsion in the same ratio as the first one, but with no HT.

The inhibited mixture of AN-oil-HT-emulsion and the reference mixture were then reacted with pyrite containing a weathering solution, which was prepared according to the method described in the AEISG code. The reaction mixtures (5 g) were kept in separate adiabatic calorimeters, which were held at 55° C. The reference mixture went to thermal runaway after 2.4 hours and the sample containing HT went to thermal runaway after 57 hours.

Examples Involving AN Powder and Inhibitor Mixtures.

Calcined and uncalcined HT powder was mixed with AN powder and their induction times were tested. The pyrite used in Examples 5 to 12 was from Spectrum Chemicals. Ammonium nitrate (Acros Organics, 99+%), Iron (II) sulphate heptahydrate (BDH, 99.5%) and Iron (III) sulphate pentahydrate (Fluka) were used as received.

Example 5

Small scale (2 g total) AN-pyrite or AN-crushed ground mixtures containing 0.9 g Pyrite or crushed ground, 0.9 g AN and 0.2 g weathering solution were mixed. Hydrotalcite was added based on the AN content, and the slurry was mixed with gentle heating to 55° C. and then sealed in a semi-adiabatic double glass cell containing a 25 ml syringe and needle to allow for the evolution of gas. The samples were heated in glycerol baths at 55, 80 or 95° C. (as described in the following Examples) until thermal runaway resulted.

As a control, an AN-pyrite or AN-crushed ground mixture without hydrotalcite reached runaway in less than 10 minutes at 55° C., at 80° C. the reaction occurred in about 2 minutes and at 95° C. within 1 minute.

Example 6: HT at 55° C.

Uncalcined HT (HT-LD) was mixed with pure pyrite, AN and weathering solution at a concentration of 3.0, and 4.16 wt. %, then heated to 55° C. in a sealed tube. The 3 wt. % sample reacted after 15 hours, and the 4.16 wt. % HT reacted after 6.75 days.

Example 7: HT at 80° C.

When Example 6 was repeated at a higher temperature of 80° C., larger concentrations of HT were needed to inhibit the reaction. In the absence of inhibitor the reaction proceeded to runaway in about 2 minutes. With 5.5 wt. % HT (HT-LD), the induction time increased to 5 days, and with 6.86 wt. % HT the induction time was 7.5 days.

Example 8: Use Calcined HT at 80° C.

If the HT sample of Examples 6 and 7 is replaced with calcined HT (calcined HT-LD) and reacted at 80° C. with 5.0 wt. % inhibitor, then the induction time increased further to 13.6 days.

Example 9: 3 wt. % Urea and 1.9 wt. % HT at 80° C.

Pure pyrite, ammonium nitrate and weathering solution containing urea at a concentration of 3.0 wt. % was combined with uncalcined HT at a concentration of 1.90 wt. % and heated to 80° C. as described in Example 5. The induction time was found to increase from about 10.4 days with 3 wt. % urea to 65.3 days with the addition of HT.

Example 10: Molecular Sieve 5A at 55° C.

Molecular sieve 5A was ground in a mortar and pestle and added to the AN-pyrite mixture at a concentration of 5.11 wt. %. The slurry was mixed and heated to 55° C. in a closed cell. The induction time was found to be about 12 hours.

Example 11: Molecular Sieve 4A at 80° C.

Molecular sieve 4A was ground in a mortar and pestle and added to the AN-pyrite mixture at a concentration of 6.22 wt. %. The slurry was mixed and heated to 80° C. in a closed cell. The induction time was found to be about 5 hours.

Example 12: Studies Using Molecular Frameworks

The molecular framework Basolite-C300 was added at a weight percentage of the AN in the AN-crush ground mixture of between 1.74 to 2.4 wt. %. The ground was sourced from Newman. This mixture was kept at 55° C. in a temperature controlled water bath until the beginning of the thermal runaway reaction. For 2.4 wt. % of Basolite, the induction time was increased from 15 minutes to 247 minutes. For 1.74 wt. % of Basolite, the induction time increased from 15 minutes to 210 minutes.

Manganese Dioxide Scavenger Examples

Small scale (approx. 5 g total) ANFO tests consisting of ground AN (2.25 g), oil/PIBSA (approx. 0.17 g), ground urea (0-5 wt. % based on AN), ground manganese dioxide (0-5 wt. % based on AN) and Pyrite (2.25 g) in weathering solution (0.5 g) were mixed. Initially the particles were dispersed in the oil phase and sonicated to disperse them. Then urea and AN were added and mixed. The PY/WS mixture was then added and the slurry mixed well. The sample was then placed in a double glass walled semi-adiabatic tube and the thermocouples placed on the outside of the inner tube. The sample was capped and a 60 ml syringe inserted and then heated gently to 55° C. The samples were heated in glycerol baths at 55° C. until thermal runaway resulted.

Example 13: ANFO with 1.86 wt. % Urea Control Test

As a control, pure ANFO systems containing only urea were prepared and reacted at 55° C. A blank ANFO mixture (5 g total) containing 1.86% urea and oil/PIBSA (6.5% oil) was mixed. To this, a slurry containing pyrite (2.25 g) in weathering solution (0.5 g) was added with thorough mixing and heated semi adiabatically to 55° C. in a glycerol bath at a heating rate not exceeding approximately 2.5° C./min. An exothermic peak was detected after an induction time of 9 hours.

Example 14: ANFO with 2.18 wt. % Urea Control Test

A blank ANFO mixture (5 g total) containing 2.18% urea and oil/PIBSA (6.5% oil) was mixed. To this, a slurry containing pyrite (2.25 g) in weathering solution (0.5 g) was added with thorough mixing and heated semi adiabatically to 55° C. in a glycerol bath at a heating rate not exceeding approx. 2.5° C./min. An exothermic peak was detected after an induction time of 2 days and 16 hours.

Example 15: Urea/Pyrolusite $MnO_2$ ANFO Test

The above experiments were repeated in the presence of 2.5 wt. % pyrolusite $MnO_2$ dispersed in the oil phase. The induction time for the 1.84% urea/$MnO_2$ system increased from 9 hours to 6 days, 14 hours. The 2.18% urea system increased from 2 days, 16 hours to 8 days, 13 hours.

Example 16: Urea/Amorphous $MnO_2$ ANFO Test at 55° C.

When 2.2% amorphous $MnO_2$ was added to 1.70% urea the induction times increased from approx. 7 hours (urea alone) to 3 days, 7 hours (with $MnO_2$). With 2.0% urea, the induction time was 1 day, 21 hours, but in the presence of 2.2% amorphous $MnO_2$ it increased to 9 days, 9 hours.

Example 17: Urea/10 Micron $MnO_2$ ANFO Test at 55° C.

When 2.48% $MnO_2$ was added to 1.92% urea the induction times increased from approx. 9 hours (urea alone) to 6 days, 2 hours (with $MnO_2$).

Example 18: Urea ANFO Control Test

Reactions done at 100° C. were heated isothermally in aluminium blocks cut to fit the glass tubes. Thermocouples were placed on the inside of the samples. A blank ANFO mixture (5 g total) containing urea and oil/PIBSA (6.5% oil) was mixed. To this, a slurry containing pyrite (2.25 g) in weathering solution (0.5 g) was added with thorough mixing and heated isothermally to 100° C. in an aluminium metal block at a heating rate not exceeding approx. 2.5° C./min. When 3.5% urea was added as a control experiment the mixture reacted after 142 minutes. When 4.0% urea was added the reaction occurred after 4 days and 22½ hours.

Example 19: Urea/Pyrolusite $MnO_2$ ANFO Test at 100° C.

Example 5 was repeated with the addition of 2.3% pyrolusite. The induction times of the 3.5% urea/$MnO_2$ sample increased from 142 minutes to 5 days, 15 hours and the 4.0% urea sample increased from 4 days, 22½ hours to 10 days, 14½ hours respectively.

Example 20: Urea/Amorphous $MnO_2$ ANFO Test at 100° C.

When 2.8% amorphous $MnO_2$ was added to 3.6% urea at 100° C., the induction times increased from 300 minutes (urea alone) to 3 days, 5½ hours in the presence of $MnO_2$.

Example 21: Urea ANFO Test (AN/Oil/Pibsa/PY/WS) at 120° C.

A blank ANFO mixture (5 g total) containing 5.36%, urea and oil/PIBSA (6.5% oil) was mixed. To this, a slurry containing pyrite (2.25 g) in weathering solution (0.5 g) was added with thorough mixing and heated isothermally to 120° C. in an aluminium metal block at a heating rate not exceeding approx. 2.5° C./min. An exothermic peak was detected after an induction time of 3 days, 20½ hours.

Example 22: Urea/$MnO_2$ ANFO Test (AN/Oil/Pibsa/PY/WS) at 120° C.

When the above example was repeated (containing 5.30% urea) with 3.24% $MnO_2$, the induction time increased from 3 days, 20½ hours to 7 days, 8½ hours.

Whilst there have been described herein particular embodiments of the present invention, the described embodiments are to be considered in all respects as illustrative only and it is to be appreciated that modifications can be made without departing from the spirit and scope of the invention.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

It is to be understood that, if any prior art publication is referred to herein, such reference does not constitute an admission that the publication forms a part of the common general knowledge in the art, in Australia or any other country.

The invention claimed is:

1. A method of scavenging NOx during an induction phase of a nitrate-based explosive of a blasting agent used in elevated temperature or reactive ground, the method comprising the steps of:

adding the nitrate-based explosive or causing the nitrate-based explosive to be added to the elevated temperature or reactive ground in an amount in the range of from 65 wt % to 94 wt % of the blasting agent, adding a hydrophobised NOx scavenger to an oil phase of the nitrate-based explosive in an amount of 1 wt % to 15 wt % of the blasting agent; and allowing the NOx scavenger to scavenge NOx species formed in the oil phase and during the induction phase in the explosive in the elevated temperature or reactive ground prior to detonation in order to remove NOx as a catalyst or reagent for any subsequent chemical reaction.

2. A method according to claim 1, wherein the hydrophobised NOx scavenger is a porous solid capable of adsorbing and/or absorbing NOx selected from zeolites, molecular framework solids, layered double hydroxides and mixtures thereof, that is hydrophobised.

3. A method according to claim 2, wherein the method further comprises the step of adding a NOx reduction catalyst in the form of a transition metal oxide in a crystalline or amorphous form that reacts with NOx, or otherwise catalyzes its reaction, to produce a species that is inert with respect to the nitrate-based explosive.

4. A method according to claim 1, wherein the nitrate-based explosive is a prill, and the oil phase comprises a fuel oil.

5. A method according to claim 1, wherein adding a hydrophobised NOx scavenger to an oil phase of the nitrate-based explosive in an amount of 1 wt % to 15 wt % of the blasting agent comprises adding a hydrophobised NOx scavenger to an oil phase of the nitrate-based explosive in an amount of 1 wt % to 7 wt % of the blasting agent.

6. A method according to claim 1, wherein the nitrate-based explosive comprises ammonium nitrate.

7. The method according to claim 1, further comprising adding to the blasting agent one or more agents selected from the group consisting of acid scavengers, gas bubbles, glass microballoons and polymer microballoons.

* * * * *